US009474932B1

(12) United States Patent
Goldberg

(10) Patent No.: US 9,474,932 B1
(45) Date of Patent: Oct. 25, 2016

(54) FINGER/HAND EXERCISER

(71) Applicant: Elliott Goldberg, Scarsdale, NY (US)

(72) Inventor: Elliott Goldberg, Scarsdale, NY (US)

( * ) Notice: Subject to any disclaimer, the term of this patent is extended or adjusted under 35 U.S.C. 154(b) by 0 days.

(21) Appl. No.: 14/800,017

(22) Filed: Jul. 15, 2015

Related U.S. Application Data

(63) Continuation-in-part of application No. 14/712,815, filed on May 14, 2015, and a continuation-in-part of application No. 14/668,011, filed on Mar. 25, 2015, and a continuation-in-part of application No. 14/518,448, filed on Oct. 20, 2014.

(51) Int. Cl.
*A63B 23/16* (2006.01)

(52) U.S. Cl.
CPC ..... *A63B 23/16* (2013.01)

(58) Field of Classification Search
CPC .. A63B 23/16; A63B 23/00; A63B 21/1449; A63B 21/1438; A63B 23/14; A63B 2071/0655; A63B 21/02–21/028; A63B 21/05; G09B 13/00; G09B 15/06
USPC ..... 482/47
See application file for complete search history.

(56) References Cited

U.S. PATENT DOCUMENTS 1,136,481 A * 4/1915 Ostrovsky ..... G09B 15/06 482/47
1,487,631 A * 3/1924 Wanger ..... A63B 23/16 482/49
1,796,216 A 3/1931 Oskar
2,118,684 A * 5/1938 Prescott ..... A63B 23/16 482/13
2,947,211 A 8/1960 Shuman
3,003,764 A * 10/1961 Lazare ..... A63B 21/00043 482/128
3,447,415 A * 6/1969 Kime ..... G09B 15/06 267/177
3,497,216 A * 2/1970 Feather ..... A63B 21/00043 482/122
3,738,651 A 6/1973 Norman et al.
3,746,336 A * 7/1973 Tanimoto ..... A63B 21/0004 482/126
3,756,594 A * 9/1973 Goodwin ..... A63D 5/00 473/55
3,847,051 A 11/1974 Miller
3,937,116 A 2/1976 Ramirez
D294,614 S 3/1988 Ditsch et al.
D325,411 S 4/1992 Everly
5,147,256 A 9/1992 Silagy
D352,754 S 11/1994 Silagy
5,383,827 A * 1/1995 Stern ..... A63B 21/00178 482/113
D359,779 S 6/1995 Peters et al.
5,431,611 A 7/1995 Silagy
5,613,923 A * 3/1997 Anliker ..... A63B 21/0004 482/44
D405,134 S 2/1999 Hug
D416,299 S 11/1999 Hug
D418,180 S 12/1999 Hug
D418,560 S 1/2000 Hug
D419,210 S 1/2000 Hug
7,967,732 B2 6/2011 D'Addario et al.
2003/0131710 A1 7/2003 Goldiner
2005/0273027 A1 * 12/2005 Farrell ..... A63B 23/16 602/21

(Continued)

*Primary Examiner* — Oren Ginsberg
*Assistant Examiner* — Andrew S Lo
(74) *Attorney, Agent, or Firm* — Weiner & Burt, P.C.; Irving M. Weiner; Pamela S. Burt

(57) ABSTRACT

A hand and finger exercise apparatus to exercise fingers or compress the entire apparatus for complete hand and forearm strengthening, and to replace interchangeable first finger button pieces with different resistance. There is also included a second finger button piece having non-adjustable means. The apparatus permits the user to easily and quickly change finger button pieces. The finger button pieces snap into the base with ease, and are removed with ease.

20 Claims, 8 Drawing Sheets

(56) References Cited

U.S. PATENT DOCUMENTS

2006/0090630 A1* 5/2006 Woods ..... A63B 21/023 84/465
2006/0178247 A1* 8/2006 Liu ..... A63B 21/0004 482/44
2006/0247102 A1* 11/2006 Kupferman ..... A63B 21/0004 482/44
2012/0065027 A1* 3/2012 Zachary ..... A63B 21/0004 482/48
2013/0196825 A1 8/2013 Silagy et al.
2015/0190675 A1* 7/2015 Silagy ..... A63B 23/16 482/47

* cited by examiner

FINGER/HAND EXERCISER

CROSS-REFERENCE TO RELATED APPLICATIONS

The present application is a continuation-in-part of and claims from priority from U.S. patent application Ser. No. 14/712,815 filed May 14, 2015, which in turn is a continuation-in-part of and claims priority from U.S. patent application Ser. No. 14/518,448 filed Oct. 20, 2014, and Ser. No. 14/668,011 filed Mar. 25, 2015.

BACKGROUND OF THE INVENTION

The present invention relates generally to improvements for a hand and finger exerciser apparatus of the type in which some or all of the engaged elements or components are pressed against the resistance or urgence of resilient members, wherein the user is given the option of exercising all or some fingers or the entire hand.

The term "non-adjustable means" as used herein means members or means which are rigid, or solid, or non-elastic and non-resilient and non-flexible and non-springy and non-supple.

More particularly, the present invention relates a hand and finger exerciser apparatus including; interchangeable removable first finger button pieces providing a first predetermined resistance to pushing it inwardly into a main base unit body structure; a removable second finger button piece that externally appears substantially identical to the first finger button piece; and the second finger button piece being provided with non-adjustable means to prevent pushing the second finger button piece inwardly into the main base unit body structure after it is locked within the main base unit body structure.

It is a desideratum of the present invention to avoid the animadversions of conventional finger/hand exercisers, and to provide an apparatus which can be used to exercise fingers or compress the entire apparatus for complete hand and forearm strengthening.

SUMMARY OF THE INVENTION

The present invention provides a hand and finger exerciser apparatus, comprising: a main base unit body structure; a plurality of interchangeable removable first finger button pieces connectible and cooperable with and slidable within said main base unit body structure; each said interchangeable removable first finger button piece providing a first predetermined resistance to pushing said interchangeable removable first finger button piece inwardly into said main base unit body structure; each interchangeable removable first finger button piece being provided with an associated cooperating locking/unlocking means forming part of the main base unit structure for selectively and individually locking the interchangeable removable first finger button piece to slide within the main base unit body structure while preventing removal of the interchangeable removable first finger button piece from the main base unit body structure, and for selectively and individually unlocking the interchangeable removable first finger button piece for removal from the main base unit body structure for replacement with another interchangeable removable first finger button piece providing a second predetermined resistance to pushing said other interchangeable removable first finger button piece inwardly into said main base unit body structure; wherein said first predetermined resistance is different than said second predetermined resistance; a removable second finger button piece which externally appears substantially identical to said first finger button piece; said second finger button piece being connectible and cooperable with said main base unit body structure; said second finger button piece being provided with an associated cooperating locking/unlocking means forming part of the main base unit structure for selectively and individually locking the second finger button piece within the main base unit body structure while preventing removal of the second finger button piece from the main base unit body structure, and for selectively unlocking the second finger button piece for removal thereof from the main base unit body structure for replacement with a first finger button piece; and said second finger button piece being provided with non-adjustable means to prevent pushing said second finger button piece inwardly into said main base unit body structure after it is locked within said main base unit body structure.

An object of the invention is to provide an apparatus as described above enabling the user to interchange first finger button pieces of different resistance.

A further object of the invention is to provide such an apparatus enabling the user to easily and quickly change resistance to any finger by changing the first finger button.

Another object is to provide such an apparatus wherein: the main base unit body structure includes a plurality of receptacles; each interchangeable removable first finger button piece being designed and dimensioned to slide within an associated one of the receptacles; said removable second finger button piece being designed and dimensioned to be locked within or removed from an associated one of the receptacles; the locking/unlocking means includes a first flexible member disposed on a side of the receptacle, and a second flexible member disposed on an opposite side of the receptacle; and pressing said first and second flexible members toward each other permits removal of an associated second finger button piece from its associated receptacle.

Another object of the invention is to provide such an apparatus wherein first and second finger buttons snap into the base with ease, and are removed with ease.

A further object of the invention is to provide an apparatus as described hereinabove wherein the base structure has a padded palm bar.

Further objects, advantages and features of the present invention will become apparent to those persons skilled in this particular area of technology and to others after being exposed to the following detailed specification and accompanying drawings.

DETAILED DESCRIPTION OF THE PRESENT INVENTION

Figure 1:
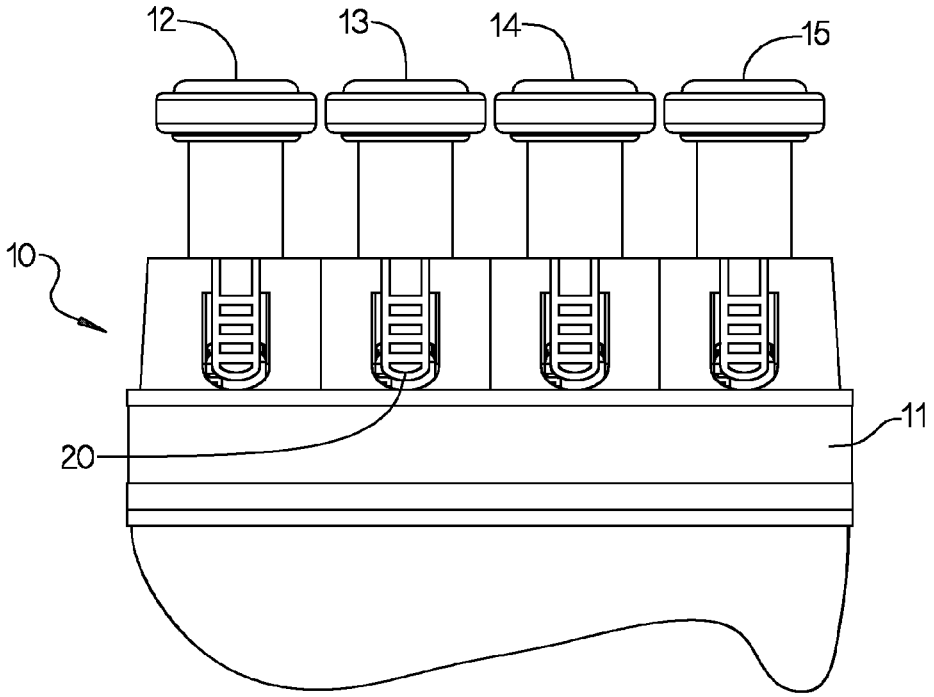
FIG. 1 is a front elevational view of an apparatus in accordance with a first embodiment of the present invention.

Referring to FIGS. 1-6, 9 and 10, there is shown an apparatus 10 in accordance with a first embodiment of the invention.

FIGS. 7-12 shows an apparatus 50 in accordance with a second embodiment which is similar in many respects to the first embodiment.

Like components are designated by like reference numbers.

The main difference between the first and second embodiments is the central guide member or pin 51 provided in the button receptacle 52 for its associated removable first finger button piece 53.

The hand and finger exerciser apparatus 10 includes a main base unit body structure 11, and a plurality of interchangeable removable first finger button pieces 12, 13, 14 and 15 connectible and cooperable with and slidable within the main base unit body structure 11.

Each interchangeable removable first finger button piece provides a first predetermined resistance to pushing the interchangeable removable first finger button piece inwardly into the main base unit body structure 11.

Each interchangeable removable first finger button piece is provided with an associated cooperating locking/unlocking means forming part of the main base unit structure 11 for selectively and individually locking the interchangeable removable first finger button piece to slide within the main base unit body structure 11 while preventing removal of the interchangeable removable first finger button piece from the main base unit body structure 11, and for selectively and individually unlocking the interchangeable removable first finger button piece for removal from the main base unit body structure 11 for replacement with another interchangeable removable first finger button piece providing a second predetermined resistance to pushing the other interchangeable removable first finger button piece downwardly or inwardly into the main base unit body structure 11.

The first predetermined resistance is different than the second predetermined resistance.

The base unit 11 is provided with four button receptacles 16, 17, 18 and 19 for the matching first finger button pieces 12, 13, 14, and 15, respectively.

Figure 5:
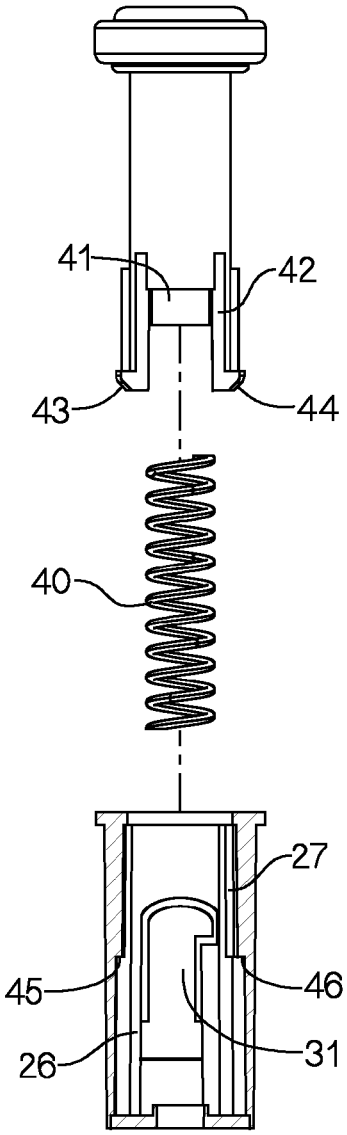
FIG. 5 is an exploded view of a first finger button piece of the first embodiment.
Figure 4:
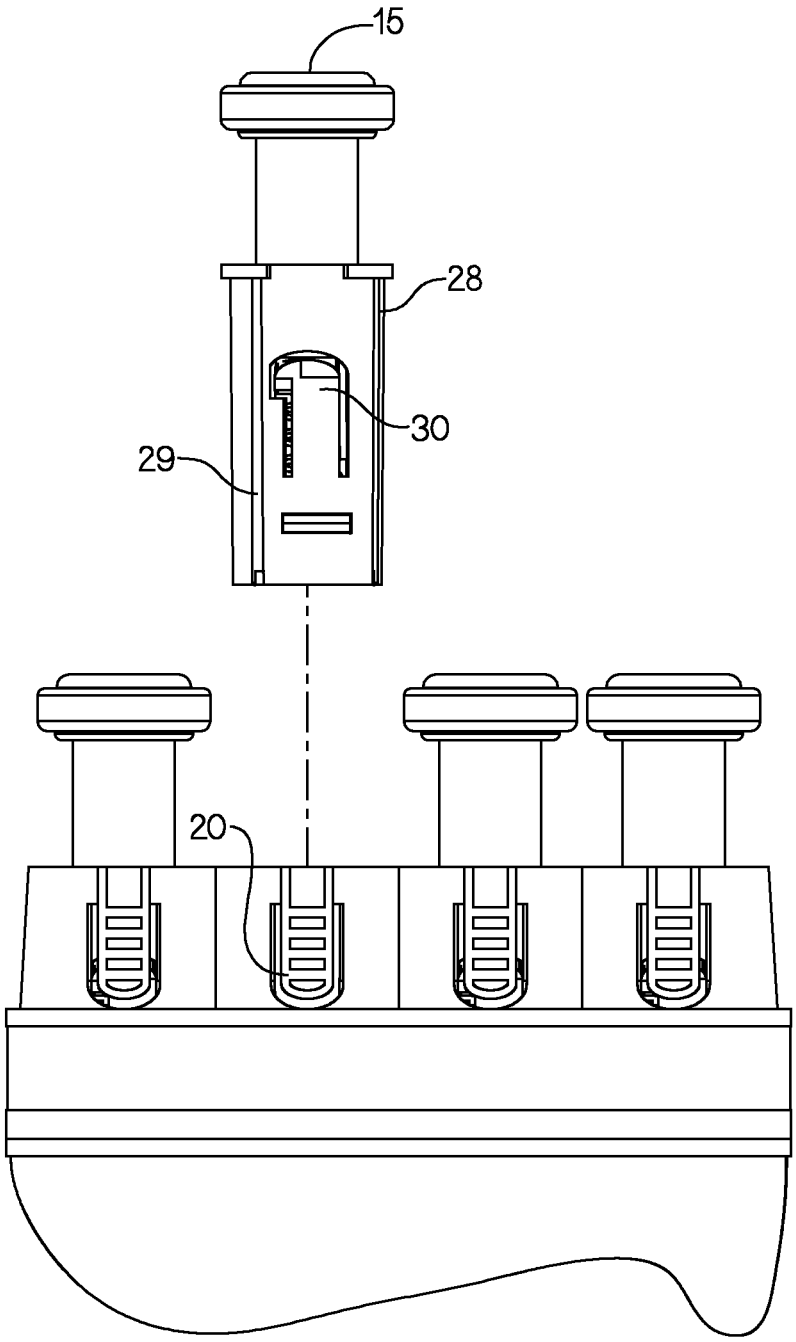
FIG. 4 illustrates a first finger button piece removed from the first embodiment.

As shown in FIG. 5, each first finger button piece is provided with a resilient resistance member, such as a spring 40, a cap member 41, a holder member 42, and abutments 43, 44, 45 and 46.

Each receptacle has a pair of pressible flexible tabs 20 and 21 formed in opposed walls of the receptacle.

Figure 2:
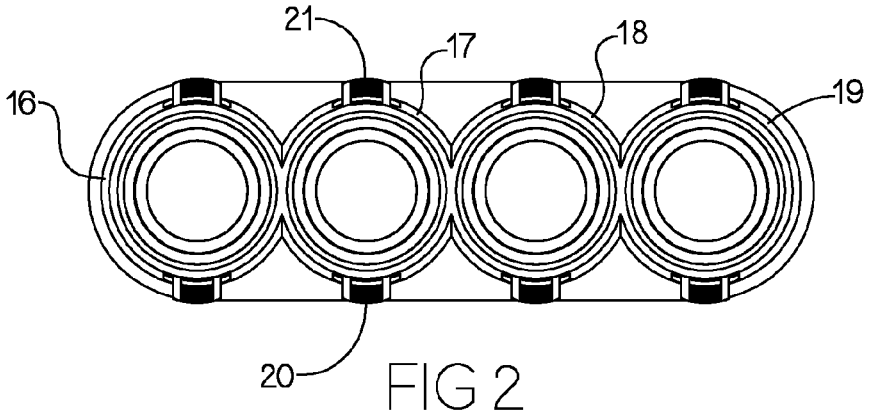
FIG. 2 is a top plan view of the FIG. 1 embodiment.
Figure 3:
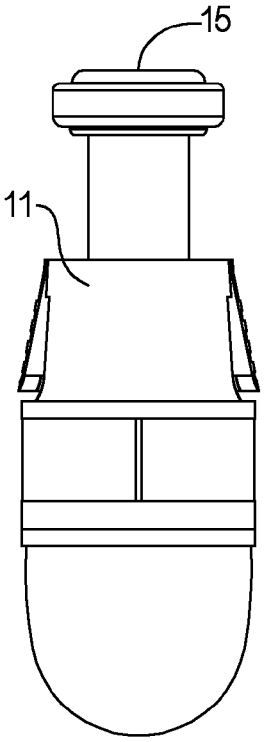
FIG. 3 is an end elevational view of the FIG. 1 embodiment.

As shown in FIG. 2, each flexible tab 20 and 21 is pivoted or cantilevered at one end to the base unit 11.

Figure 7:
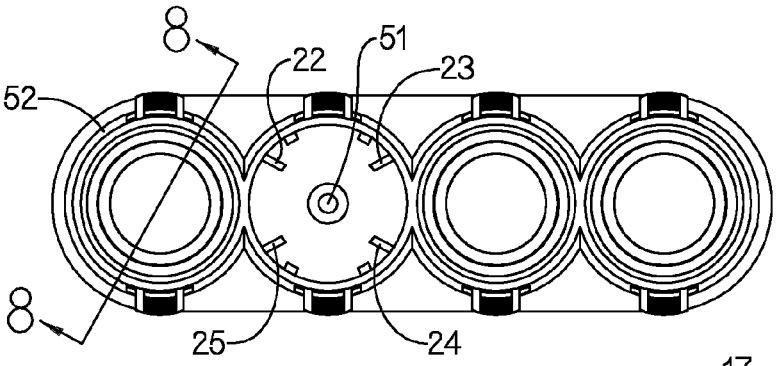
FIG. 7 depicts a top plan view of a second embodiment shown with one first finger button removed.

Each receptacle has four main inwardly-projecting elongated members 22, 23, 24 and 25 as shown in FIG. 7.

The interchangeable removable first finger button piece is provided with a plurality of elongated notches 26, 27, 28 and 29 which slidingly mate with the inwardly projecting elongated members 22, 23, 24 and 25, respectively, of the receptacle.

Each interchangeable removable first finger button piece 12, 13, 14 or 15 is designed and dimensioned to slide within an associated one of the receptacles 16, 17, 18 or 19, respectively.

The locking/unlocking means includes a first flexible member 20 disposed on a side of the receptacle, and a second flexible member 21 disposed on an opposite side of the receptacle.

Pressing the first and second flexible members 20 and 21 toward each other permits removal of the first finger button piece from its receptacle.

Each interchangeable removable first finger button piece is provided with a third flexible member 30 disposed on a side of the first finger button piece, and a fourth flexible member 31 disposed on an opposite side of the first finger button piece.

Pressing the first and second flexible members 20 and 21 toward each other contacts and flexes the third and fourth flexible member 30 and 31, respectively, inwardly to permit removal of the first finger button piece from its receptacle.

Figure 9:
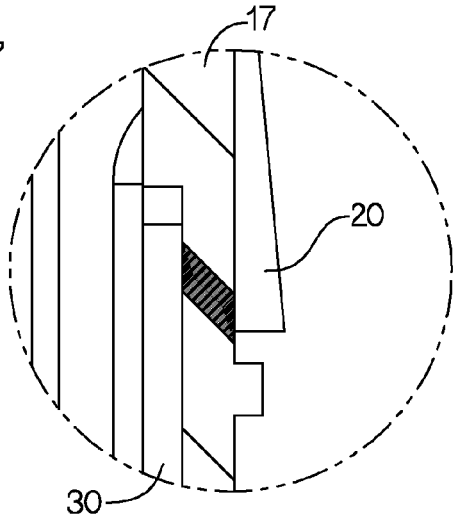
FIG. 9 is an exploded view showing the first finger button piece in a locked position.
Figure 8:
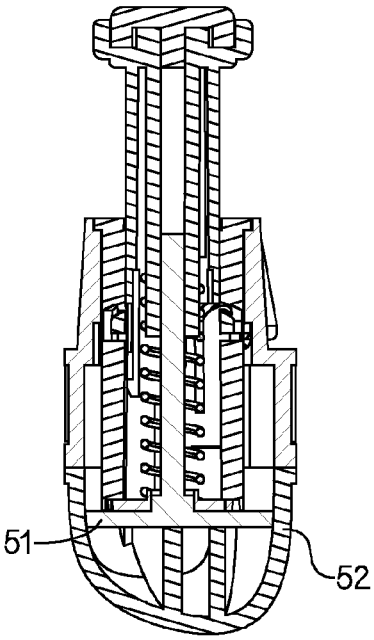
FIG. 8 shows a sectional view taken along the line 8-8 of FIG. 7.
Figure 10:
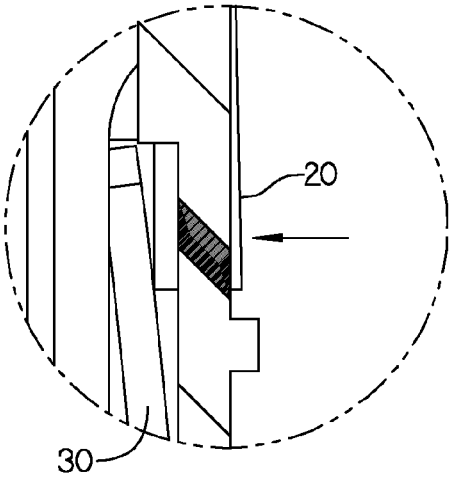
FIG. 10 is an exploded view showing the first finger button piece in an unlocked position.
Figure 11:
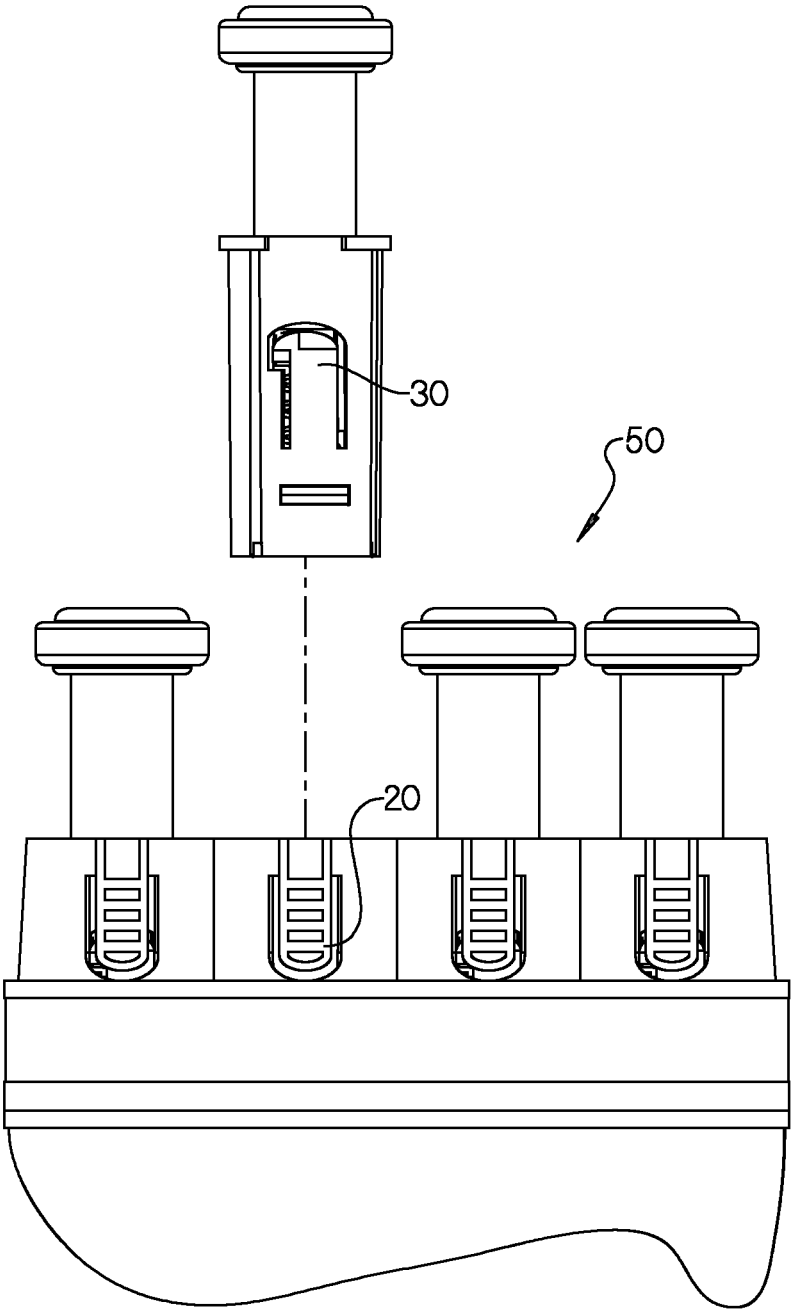
FIG. 11 illustrates a first finger button piece removed from the second embodiment.
Figure 12:
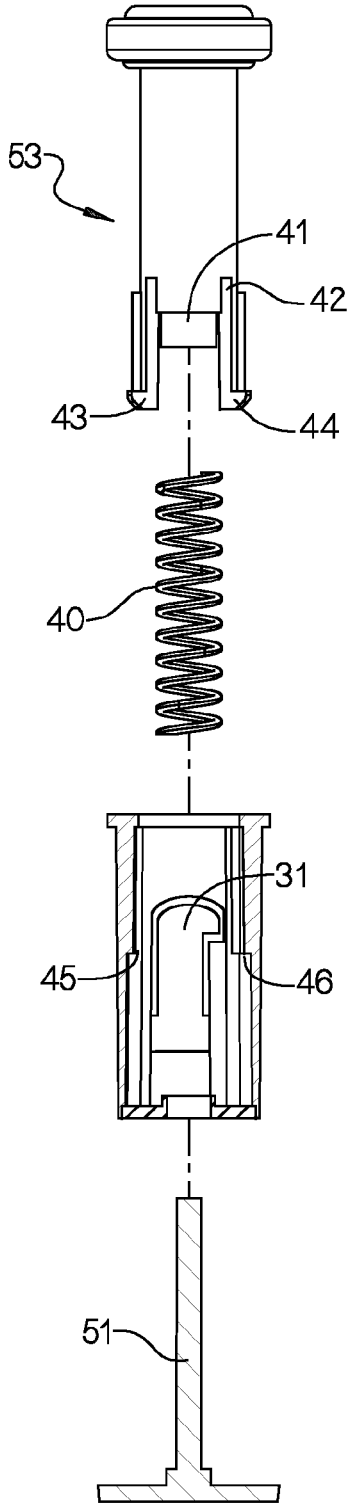
FIG. 12 is an exploded view of a first finger button piece of the second embodiment and its central guide member.

This is best illustrated by FIGS. 9 and 10, where FIG. 9 is an exploded view showing the first finger button piece in a locked position, and FIG. 10 is an exploded view showing the first finger button piece in an unlocked position.

Figure 6:
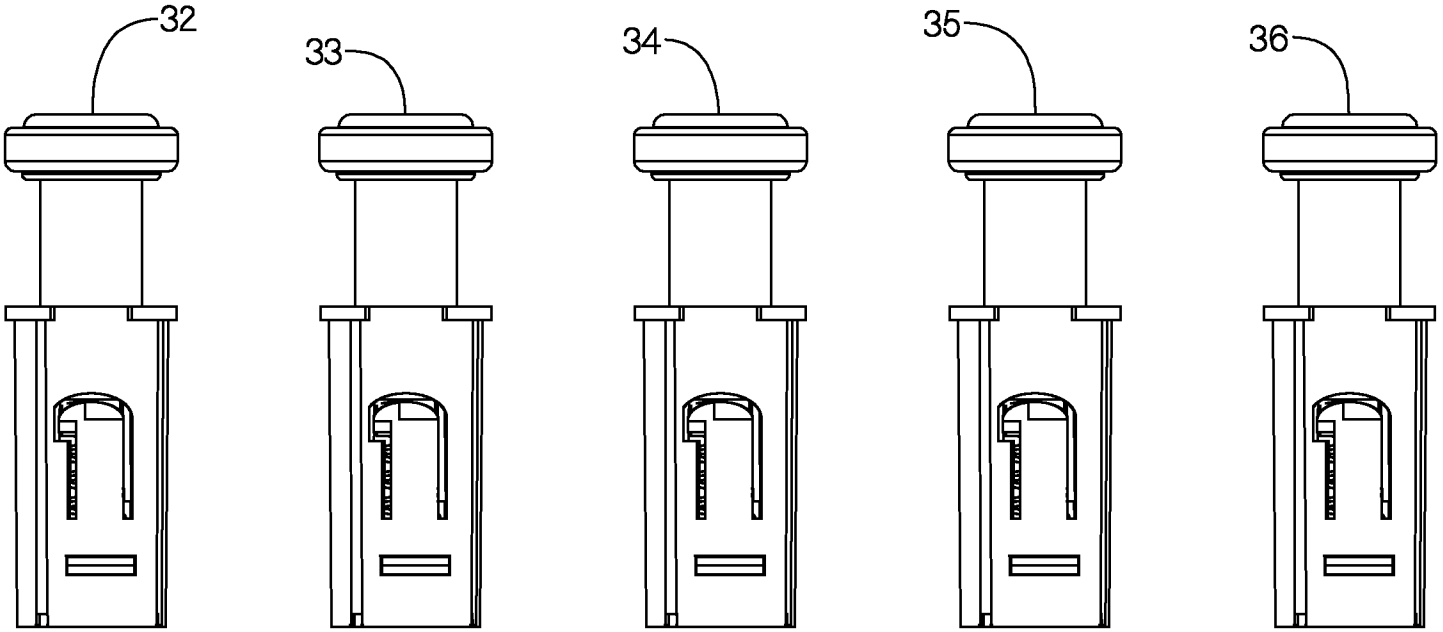
FIG. 6 is a view of a series of replacement first finger button pieces having different resistances.

As shown in FIG. 6, there is provided additional first finger button pieces 32, 33, 34, 35 and 36 to replace the matching first finger button pieces with different resistance pieces and which may be color-coded or otherwise identified.

For example, there may be eight levels of resistance or first finger buttons available, such as, tan (xx-light), yellow (x-light), red (light), green (medium), blue (heavy), black (x-heavy), silver (xx-heavy), and gold (xxx-heavy).

The apparatus 50 shown in FIGS. 7-12 includes the fixed central axial guide pin device 51 affixed internally in the receptacle.

The first finger button piece slides on the fixed central axial guide pin device 51.

Figure 13:
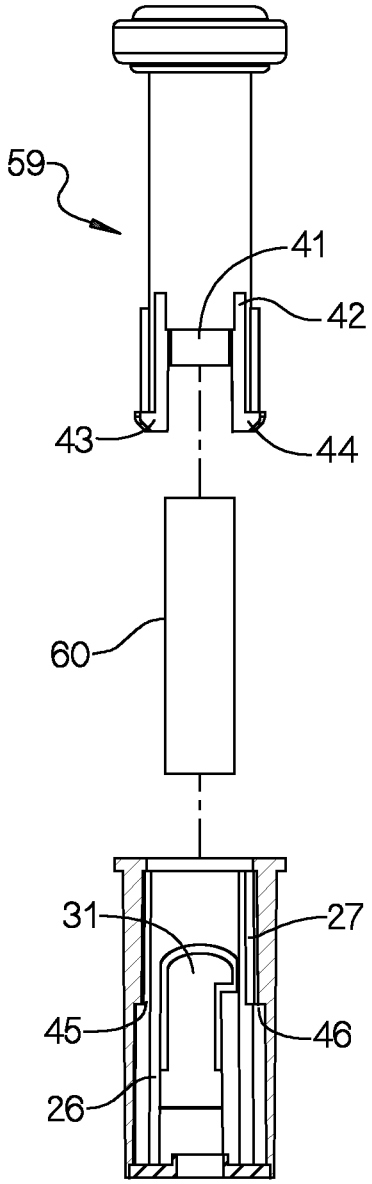
FIG. 13 shows a first embodiment of a non-adjustable second finger button piece.

As shown in FIG. 13, a second finger button piece 59 is provided with non-adjustable means, such as a rigid member 60, a cap member 41, a holder member 42, and abutments 43, 44, 45 and 46.

Figure 14:
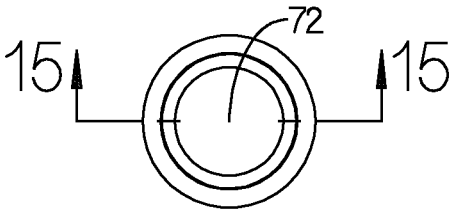
FIG. 14 shows a top view of a second embodiment of a non-adjustable second finger button piece.

FIG. 14 shows a top view of a second embodiment of a non-adjustable second finger button piece 70.

Figure 15:
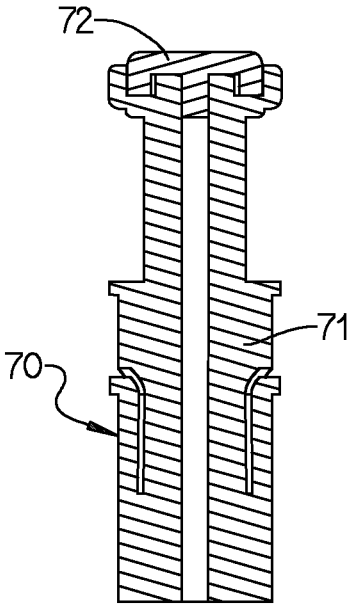
FIG. 15 shows a cross-sectional view of the second embodiment of a non-adjustable second finger button piece taken along the line 15-15 depicted in FIG. 14.

FIG. 15 shows a cross-sectional view of the second embodiment of a non-adjustable second finger button piece 70 taken along the line 15-15 depicted in FIG. 14.

Figure 16:
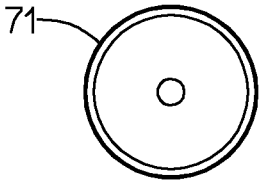
FIG. 16 shows a bottom view of the second embodiment of a non-adjustable second finger button piece.

FIG. 16 shows a bottom view of the second embodiment of a non-adjustable second finger button piece 70.

The finger button 70 includes an one-piece molded part 71 and an one-piece molded cap member 72.

Alternatively, the second finger button piece can be fabricated entirely as an unitary one-piece structure.

The second finger button piece 59 or 70 is not adjustable and can be added or removed as the adjustable first finger buttons pieces can be added or removed.

The reason or purpose for the non-adjustable second finger button piece 59 or 70 is to act as a "lock" when pressure is exerted so that movement will not be allowed in the instance(s) where movement is counter indicated.

The second finger button piece 59 or 70 visually looks and performs as the adjustable "spring-loaded" first finger button pieces with one main difference.

Instead of a spring, there is a non-elastic member 60 (of any shape to hold the piece 59 in a disengaged elongated shape) or the finger button piece 59 will be held open by some other means (glue, welding, product design, unitized structure, or one-piece molded product).

The second finger button piece 59 or 70 is intended to be used in conjunction with the first embodiment described above with reference to FIGS. 1-6, 9 and 10.

While the present invention has been described in detail with reference to only two particular embodiments thereof, it should be understood that this has been described by way of illustration only, and not by way of limitation.

Reasonable variation and modification are possible within the spirit of the foregoing specification and drawings without departing from the scope of the invention which is defined in the accompanying claims.

The present invention embraces all embodiments, modifications, variations and changes which come within the scope of the patent claims set forth hereinbelow.

The invention claimed is:

1. A hand and finger exerciser apparatus, comprising:

a main base unit body structure;

a plurality of interchangeable removable first finger button pieces connectible and cooperable with and slidable within said main base unit body structure;

each said interchangeable removable first finger button piece providing a first predetermined resistance to pushing said interchangeable removable first finger button piece inwardly into said main base unit body structure;

each interchangeable removable first finger button piece being provided with an associated cooperating locking/unlocking means forming part of the main base unit structure for selectively and individually locking the interchangeable removable first finger button piece to slide within the main base unit body structure while preventing removal of the interchangeable removable first finger button piece from the main base unit body structure, and for selectively and individually unlocking the interchangeable removable first finger button piece for removal from the main base unit body structure for replacement with another interchangeable removable first finger button piece providing a second predetermined resistance to pushing said other interchangeable removable first finger button piece inwardly into said main base unit body structure;

wherein said first predetermined resistance is different than said second predetermined resistance;

a removable second finger button piece which externally appears substantially identical to said first finger button piece;

said second finger button piece being connectible and cooperable with said main base unit body structure;

said second finger button piece being provided with an associated cooperating locking/unlocking means forming part of the main base unit structure for selectively and individually locking the second finger button piece within the main base unit body structure while preventing removal of the second finger button piece from the main base unit body structure, and for selectively unlocking the second finger button piece for removal thereof from the main base unit body structure for replacement with a first finger button piece; and said second finger button piece being provided with non-adjustable means or being a non-adjustable unitary one-piece structure to prevent pushing said second finger button piece inwardly into said main base unit body structure after it is locked within said main base unit body structure.

2. The apparatus of claim 1, wherein:

the main base unit body structure includes a plurality of receptacles;

each interchangeable removable first finger button piece being designed and dimensioned to slide within an associated one of the receptacles;

said removable second finger button piece being designed and dimensioned to be locked within or removed from an associated one of the receptacles;

the locking/unlocking means includes a first flexible member disposed on a side of the receptacle, and a second flexible member disposed on an opposite side of the receptacle; and pressing said first and second flexible members toward each other permits removal of an associated second finger button piece from its associated receptacle.

3. The apparatus of claim 1, including:

interchangeable removable first finger button pieces of different resistance ranging from extremely light resistance to extremely heavy resistance.

4. The apparatus of claim 2, including:

interchangeable removable first finger button pieces of different resistance ranging from extremely light resistance to extremely heavy resistance.

5. The apparatus of claim 2, wherein:

the interchangeable removable first finger button piece snaps into an associated receptacle for selective retention therein; and the second finger button piece snaps into an associated receptacle for selective retention therein.

6. The apparatus of claim 4, wherein:

the interchangeable removable first finger button piece snaps into an associated receptacle for selective retention therein; and the second finger button piece snaps into an associated receptacle for selective retention therein.

7. The apparatus of claim 2, wherein:

the receptacle is provided with a plurality of inwardly projecting elongated members; and the first and second finger button pieces are each provided with a plurality of elongated notches which slidingly mate with the inwardly projecting elongated members of the receptacle.

8. The apparatus of claim 4, wherein:

the receptacle is provided with a plurality of inwardly projecting elongated members; and the first and second finger button pieces are each provided with a plurality of elongated notches which slidingly mate with the inwardly projecting elongated members of the receptacle.

9. The apparatus of claim 5, wherein:

the receptacle is provided with a plurality of inwardly projecting elongated members; and the first and second finger button pieces are each provided with a plurality of elongated notches which slidingly mate with the inwardly projecting elongated members of the receptacle.

10. The apparatus of claim 6, wherein:

the receptacle is provided with a plurality of inwardly projecting elongated members; and the first and second finger button pieces are each provided with a plurality of elongated notches which slidingly mate with the inwardly projecting elongated members of the receptacle.

11. The apparatus of claim 2, wherein:

each first and second finger button piece is provided with a third flexible member disposed on a side of the finger button piece, and a fourth flexible member disposed on an opposite side of the finger button piece; and pressing said first and second flexible members toward each other contacts and flexes the third and fourth flexible member inwardly to permit removal of the finger button piece from its receptacle.

12. The apparatus of claim 4, wherein:

each first and second finger button piece is provided with a third flexible member disposed on a side of the finger button piece, and a fourth flexible member disposed on an opposite side of the finger button piece; and pressing said first and second flexible members toward each other contacts and flexes the third and fourth flexible member inwardly to permit removal of the finger button piece from its receptacle.

13. The apparatus of claim 5, wherein:

each first and second finger button piece is provided with a third flexible member disposed on a side of the finger button piece, and a fourth flexible member disposed on an opposite side of the finger button piece; and pressing said first and second flexible members toward each other contacts and flexes the third and fourth flexible member inwardly to permit removal of the finger button piece from its receptacle.

14. The apparatus of claim 6, wherein:

each first and second finger button piece is provided with a third flexible member disposed on a side of the finger button piece, and a fourth flexible member disposed on an opposite side of the finger button piece; and pressing said first and second flexible members toward each other contacts and flexes the third and fourth flexible member inwardly to permit removal of the finger button piece from its receptacle.

15. The apparatus of claim 7, wherein:

each first and second finger button piece is provided with a third flexible member disposed on a side of the finger button piece, and a fourth flexible member disposed on an opposite side of the finger button piece; and pressing said first and second flexible members toward each other contacts and flexes the third and fourth flexible member inwardly to permit removal of the finger button piece from its receptacle.

16. The apparatus of claim 8, wherein:

each first and second finger button piece is provided with a third flexible member disposed on a side of the finger button piece, and a fourth flexible member disposed on an opposite side of the finger button piece; and pressing said first and second flexible members toward each other contacts and flexes the third and fourth flexible member inwardly to permit removal of the finger button piece from its receptacle.

17. The apparatus of claim 9, wherein:

each first and second finger button piece is provided with a third flexible member disposed on a side of the finger button piece, and a fourth flexible member disposed on an opposite side of the finger button piece; and pressing said first and second flexible members toward each other contacts and flexes the third and fourth flexible member inwardly to permit removal of the finger button piece from its receptacle.

18. The apparatus of claim 10, wherein:

each first and second finger button piece is provided with a third flexible member disposed on a side of the finger button piece, and a fourth flexible member disposed on an opposite side of the finger button piece; and pressing said first and second flexible members toward each other contacts and flexes the third and fourth flexible member inwardly to permit removal of the finger button piece from its receptacle.

19. The apparatus of claim 1, wherein:

the second finger button piece may include an one-piece molded main part and an one-piece molded cap member for the main part, or the second finger button piece can be fabricated entirely as an unitary one-piece structure.

20. The apparatus of claim 2, wherein:

the second finger button piece may include an one-piece molded main part and an one-piece molded cap member for the main part, or the second finger button piece can be fabricated entirely as an unitary one-piece structure.

* * * * *